US011440788B2

(12) United States Patent
Doery et al.

(10) Patent No.: US 11,440,788 B2
(45) Date of Patent: Sep. 13, 2022

(54) BEVERAGE TAP

(71) Applicant: KegLand Holdings Pty Ltd, Burnley (AU)

(72) Inventors: Kee Doery, Burnley (AU); Dominic Evans, Burnley (AU)

(73) Assignee: KEGLAND HOLDINGS, Burnley (AU)

( * ) Notice: Subject to any disclaimer, the term of this patent is extended or adjusted under 35 U.S.C. 154(b) by 0 days.

(21) Appl. No.: 17/211,337

(22) Filed: Mar. 24, 2021

(65) Prior Publication Data

US 2022/0098023 A1 Mar. 31, 2022

Related U.S. Application Data

(60) Provisional application No. 63/085,067, filed on Sep. 29, 2020.

(51) Int. Cl.
*B67D 1/12* (2006.01)
*B67D 3/00* (2006.01)
*B67D 3/02* (2006.01)

(52) U.S. Cl.
CPC ..... *B67D 3/0041* (2013.01); *B67D 1/1277* (2013.01); *B67D 3/02* (2013.01); *B67D 2210/00141* (2013.01)

(58) Field of Classification Search
CPC ..... B67D 3/0041; B67D 1/1277; B67D 3/02; B67D 2210/00141
See application file for complete search history.

(56) References Cited

U.S. PATENT DOCUMENTS 2,035,202 A * 3/1936 Smith ..... B67D 3/043 251/263
2,575,658 A * 11/1951 Del Nero ..... B67D 1/1466 137/636
4,078,578 A * 3/1978 Buchholz ..... B67D 1/1466 137/614.19
4,720,076 A * 1/1988 Hyde ..... B67D 3/043 239/110
4,742,942 A * 5/1988 Dokos ..... B67D 1/1416 137/600
5,244,117 A * 9/1993 Lombardo ..... B67D 1/1461 222/394
5,538,028 A * 7/1996 Lombardo ..... B67D 1/0456 137/170.1
5,794,823 A * 8/1998 Roundtree ..... B67D 1/1433 222/400.7
5,845,824 A * 12/1998 Weimer ..... B67D 1/1466 222/509
6,041,970 A * 3/2000 Vogel ..... B67D 1/0462 251/120

(Continued)

*Primary Examiner* — Frederick C Nicolas
(74) *Attorney, Agent, or Firm* — Christensen, Fonder, Dardi & Herbert PLLC

(57) ABSTRACT

A tap for dispensing a beverage. The tap includes: a tap body defining a beverage outlet and including a closure member seat; a closure member movably disposed within the tap body and including a head movable into sealing engagement with the closure member seat, wherein the head has a streamlined configuration and the closure member seat is intermediate the closure member and the beverage outlet; and an externally operable actuator operationally coupled to the closure member.

18 Claims, 12 Drawing Sheets

(56) References Cited

U.S. PATENT DOCUMENTS

| | | | | |
|---|---|---|---|---|
| 6,457,614 | B1 * | 10/2002 | Amidzich | B67D 1/1466 251/129.21 |
| 7,077,299 | B2 * | 7/2006 | Amidzich | B67D 1/1466 251/129.21 |
| 7,278,454 | B2 * | 10/2007 | Younkle | F16K 1/12 222/509 |
| 7,513,398 | B2 * | 4/2009 | Miller | B67D 1/1461 251/343 |
| 7,815,079 | B2 * | 10/2010 | Saveliev | B67D 1/1213 222/509 |
| 8,656,952 | B2 * | 2/2014 | Arov | B67D 1/1472 137/613 |
| 2008/0314936 | A1 * | 12/2008 | Robinson | B67D 1/145 222/509 |
| 2009/0242590 | A1 * | 10/2009 | Saveliev | B67D 1/0006 222/509 |

* cited by examiner

BEVERAGE TAP

PRIORITY CLAIM

This application claims the benefit of U.S. Provisional Patent Application No. 63/085,067, filed Sep. 29, 2020, the disclosure of which is incorporated by reference herein.

TECHNICAL FIELD

The disclosure herein generally relates to a tap for dispensing a beverage, and specifically but not exclusively to a tap for dispensing a carbonated beverage.

BACKGROUND

Beer, for example, may be carbonated and stored in a keg. A gas conduit ("gas line") may communicate gas from a pressurised cylinder of carbon dioxide to the keg. A fluid line ("beer line") may communicate beer from the keg to a tap ("beer tap" or "dispensing tap") for dispensing the beer. Similar systems may be used for dispensing fizzy soft drinks, sparking wine, sparkling mineral water or generally any carbonated beverage.

Taps for dispensing carbonated beverages, however, may cause excess foaming of the carbonated beverage when dispensed thereby. Apart from a naturally developing beer head, for example, foaming is generally regarded as a dispensing fault, and in the worst case can result in a glass full of undrinkable foam or a flat beverage. While some users may wish to control the rate at which a beverage flows from a tap, some taps are designed to only be fully on or fully off, and when operated intermediate these two positions may result in excessive foaming.

SUMMARY

Disclosed herein is a beverage tap. The beverage tap comprises a tap body defining a beverage outlet and comprising a closure member seat. The beverage tap comprises a closure member movably disposed within the tap body and comprising a head movable into sealing engagement with the closure member seat. The head has a streamlined configuration and the closure member seat is intermediate the closure member and the beverage outlet. The beverage tap comprises an externally operable actuator operationally coupled to the closure member.

In an embodiment, the head comprises a rounded portion.

In an embodiment, the head comprises a tip having a nipple configuration.

In an embodiment, the head is smooth.

In an embodiment, the head is fissure free.

In an embodiment, the closure member comprises a tail having a streamlined configuration.

In an embodiment, the tail comprises a rounded portion.

In an embodiment, the tail is smooth.

In an embodiment, the tail is fissure free.

In an embodiment, the closure member comprises a plurality of laterally disposed alignment elements aft of the head.

In an embodiment, each of the plurality of laterally disposed alignment elements has a streamlined configuration.

In an embodiment, each of the laterally disposed alignment elements comprises a tapered forward end directed towards the outlet and rounded aft end.

In an embodiment, the externally operable actuator is received within a cavity defined by the closure member.

In an embodiment, the closure member comprises polymer.

In an embodiment, the closure member comprises a skeleton overmolded with a polymer overmold. The skeleton may be internal.

In an embodiment, the tap body defines a beverage passageway in which is disposed an externally adjustable passageway constrictor for adjusting a flow rate of the beverage through the beverage passageway.

In an embodiment, the externally adjustable passageway constrictor comprises an insert comprising a tapered end inserted within a sleeve defining a tapered end receiver that is correspondingly tapered.

In an embodiment, the sleeve is movably mounted within the beverage passageway. Another externally operable actuator may be operationally coupled to the sleeve.

An embodiment comprises a closure member biasing element intermediate of the closure member and the insert.

Any of the various features of each of the above disclosures, and of the various features of the embodiments described below, can be combined as suitable and desired.

BRIEF DESCRIPTION OF THE FIGURES

Embodiments will now be described by way of example only with reference to the accompanying figures in which.

DESCRIPTION OF EMBODIMENTS

Figure 2:
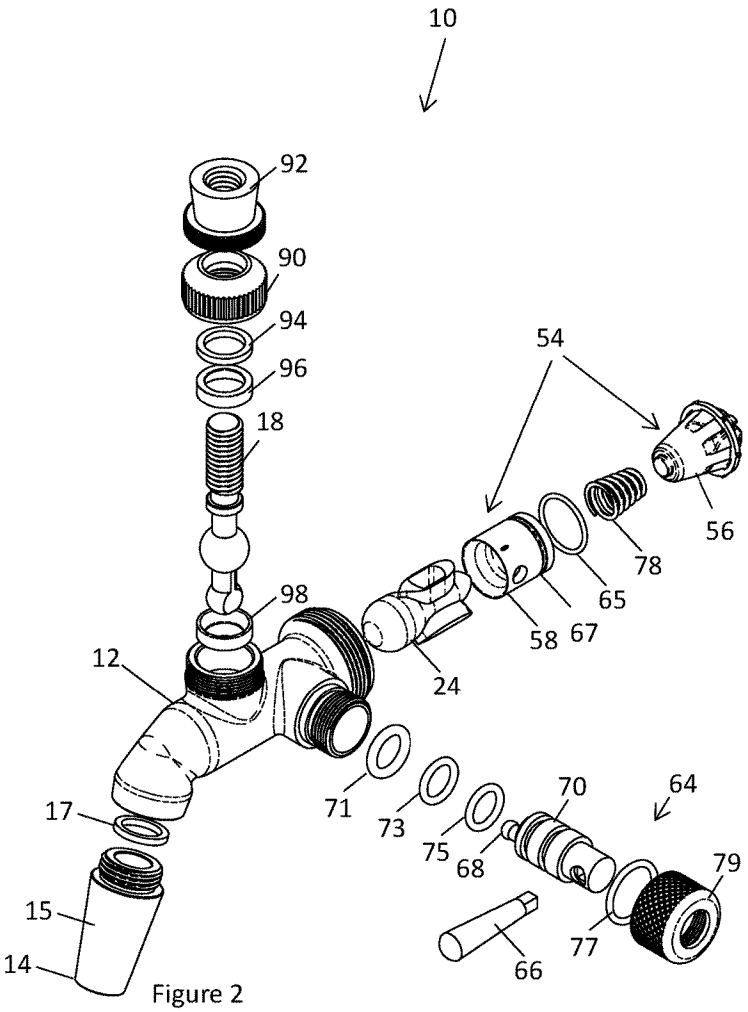
FIGS. 1 and 2 respectively show a side elevational and an exploded perspective view of an embodiment of a beverage tap.
Figure 1:
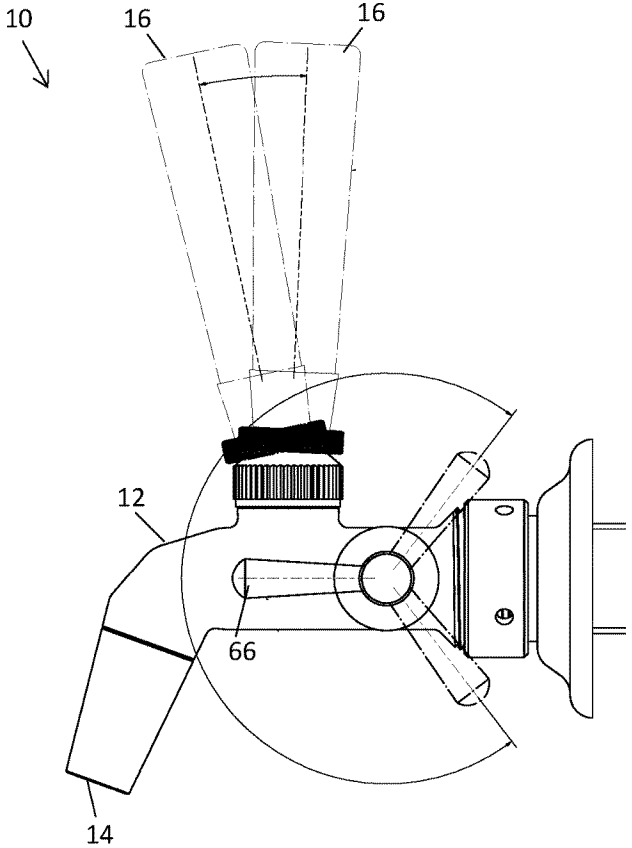

FIGS. 1 and 2 respectively show a side elevational view and an exploded perspective view of an embodiment of a beverage tap ("tap") in the form of a forward sealing beverage tap, generally indicated by the numeral 10. The tap 10 is for dispensing a beverage in the form of a carbonated beverage, examples of which include but are not limited to beers, sparking wines, sparkling mineral waters, and fizzy soft drinks, however the tap 10 may be used for dispensing non-carbonated beverages, for example flat mineral water or generally any suitable carbonated beverage. The tap 10 comprises a tap body 12 defining a beverage outlet ("outlet") 14. The tap 10 has attached thereto an optional user control 16 in the form of an attached handle that can be pulled towards the outlet 14 (forwardly) to open the tap 10. FIG. 1 shows the positions of the handle 16 when the tap 10 is open and closed.

Figure 3:
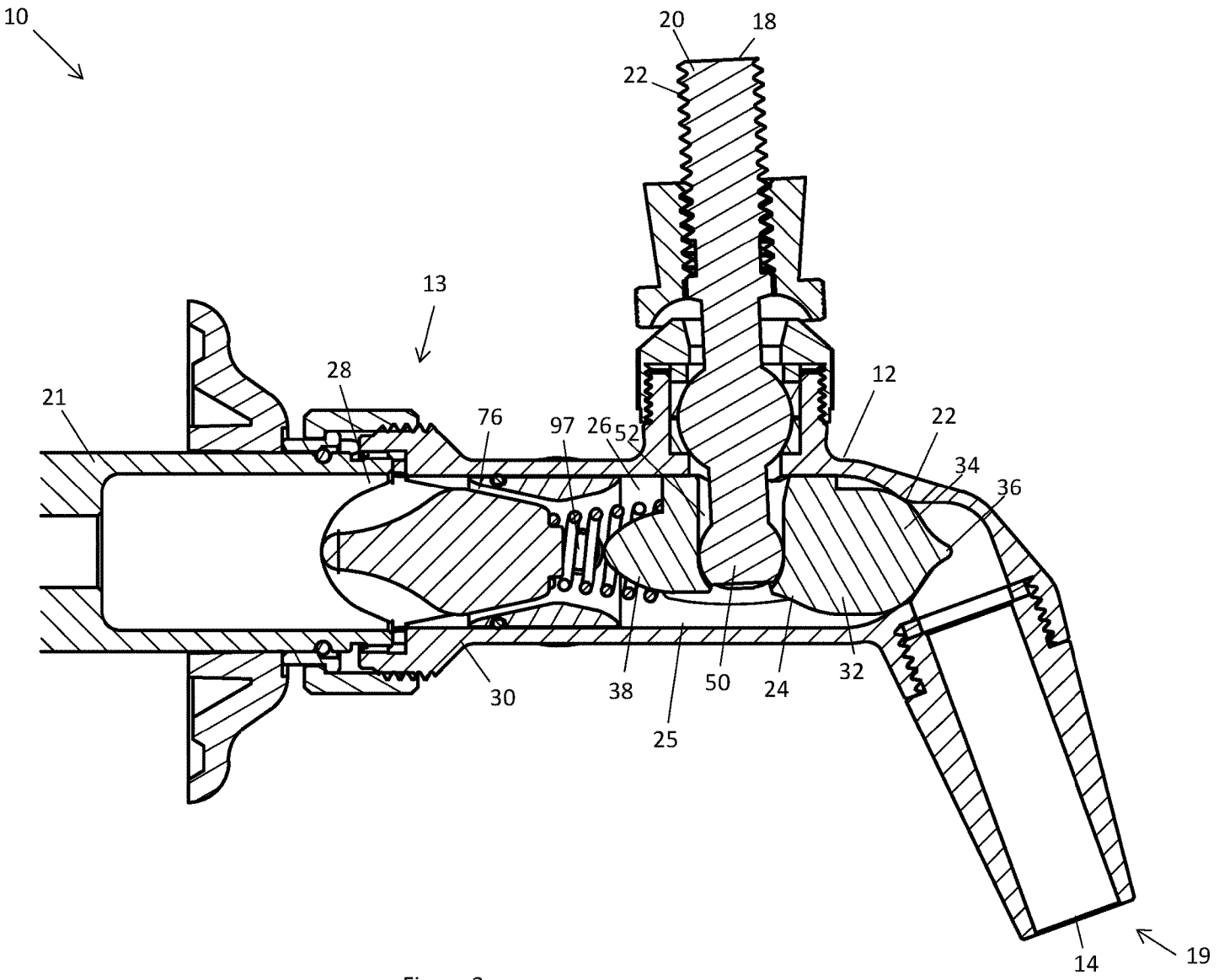
FIGS. 3 and 4 show cross sectional views of the tap 10 of FIG. 1 in off (closed) and on (open) configurations respectively, with a flow constrictor in a mode for more flow through the tap.
Figure 4:
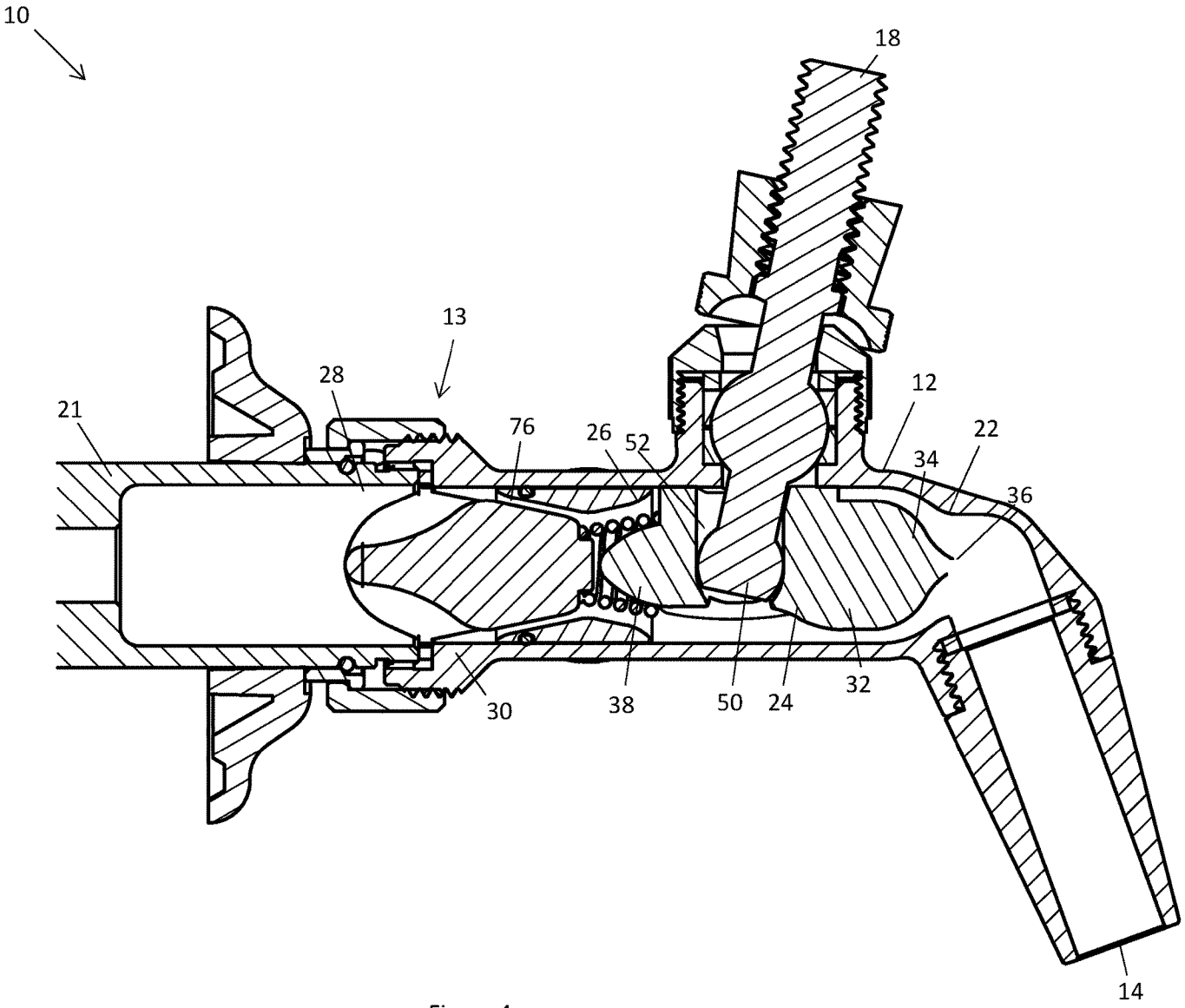
Figure 6:
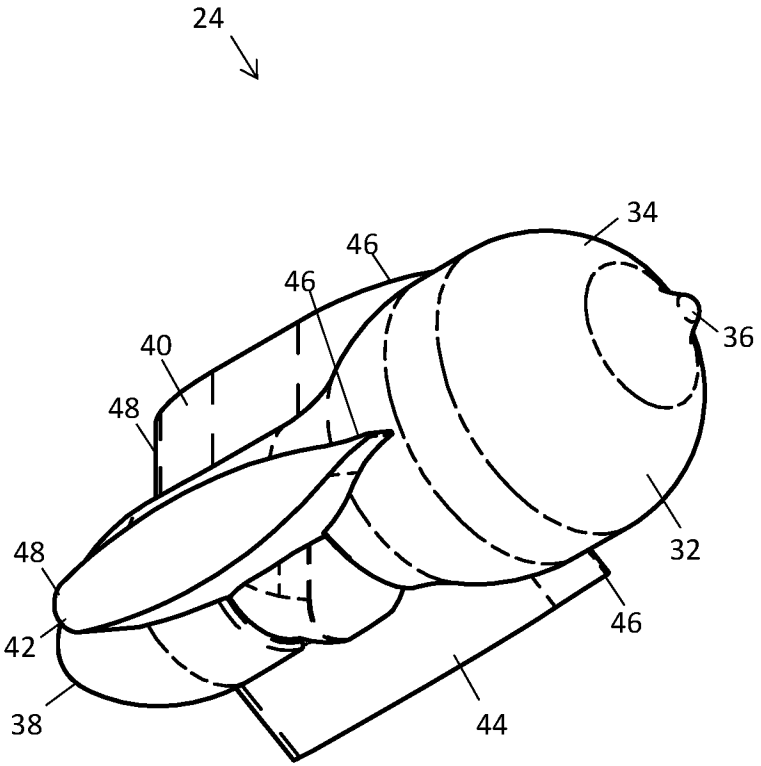
FIGS. 5 and 6 show perspective views of a closure member of the tap of FIG. 1.
Figure 5:
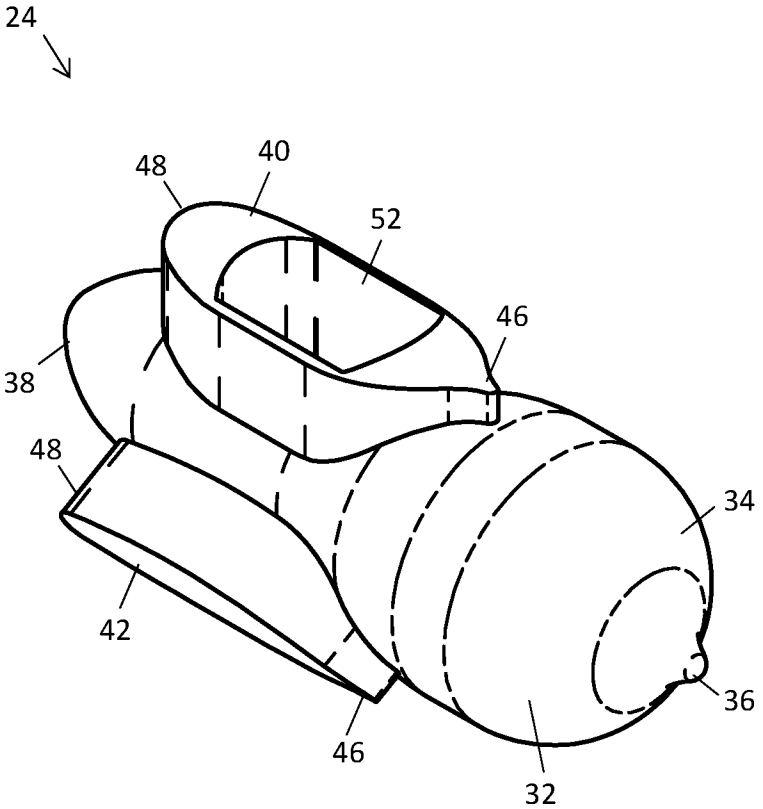
Figure 8:
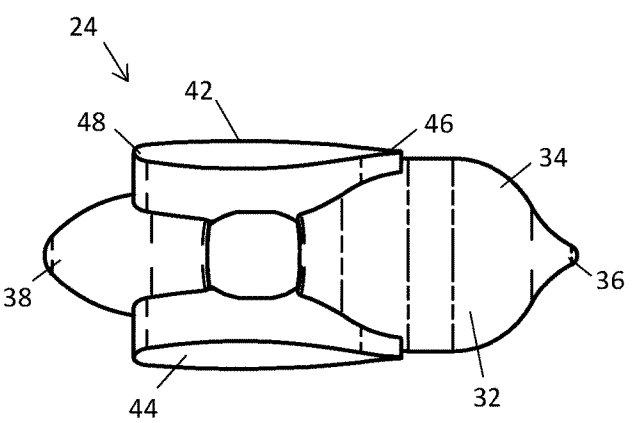
FIG. 8 shows a bottom view of the closure member of FIG. 5
Figure 7:
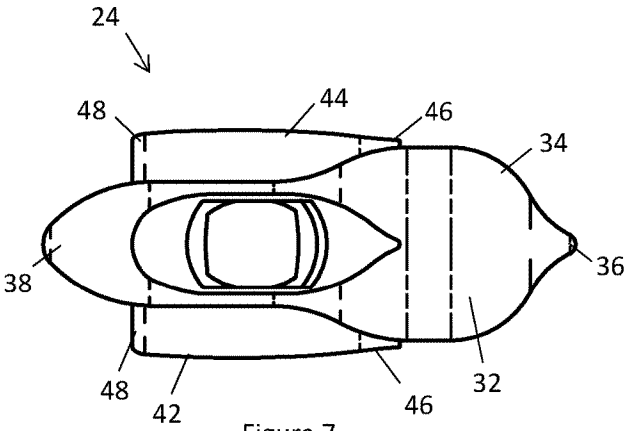
FIG. 7 shows a plan view of the closure member of FIG. 5.
Figure 9:
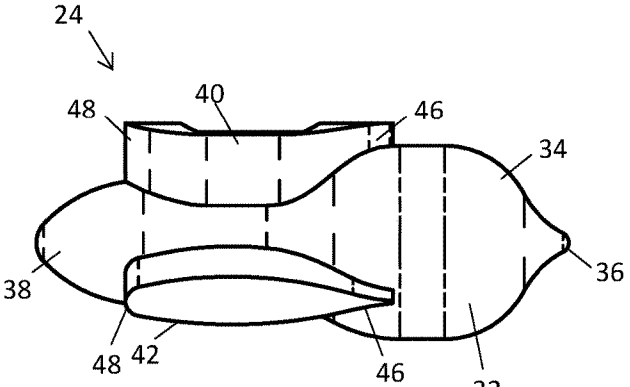
FIG. 9 shows a side elevation view of the closure member of FIG. 5.
Figure 11:
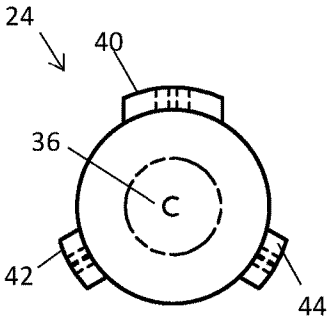
FIG. 11 shows a forward end view of the closure member of FIG. 5.
Figure 10:
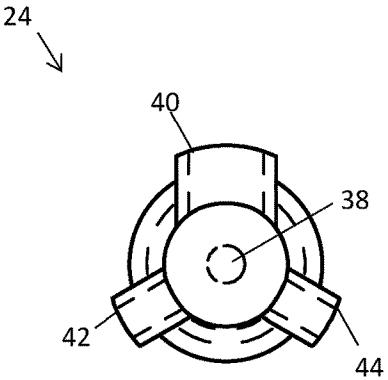
FIG. 10 shows an aft end view of the closure member of FIG. 5.
Figure 13:
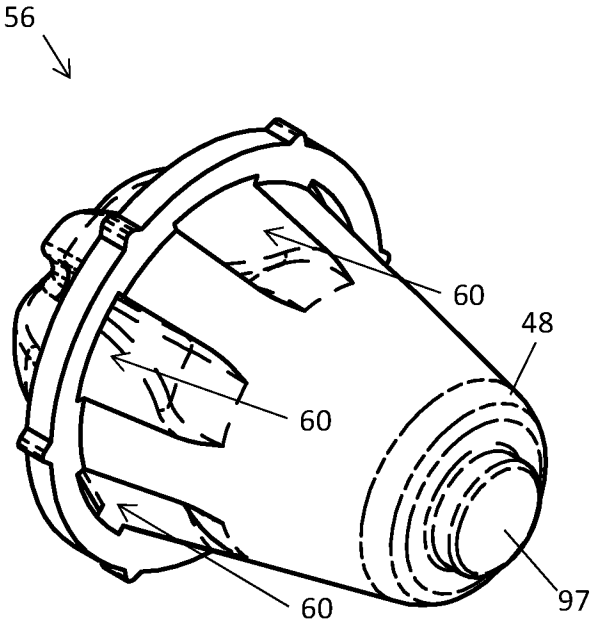
FIGS. 12 and 13 show perspective views of an insert of the tap of FIG. 1.
Figure 12:
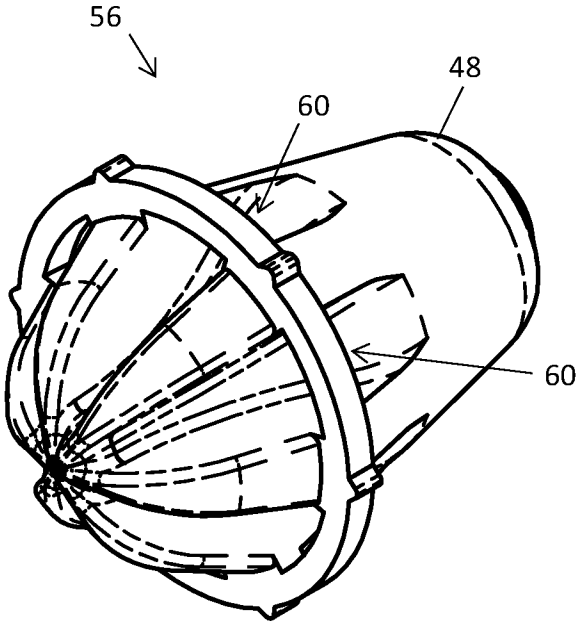
Figure 16:
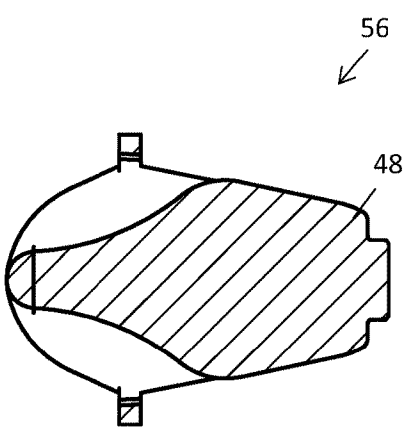
FIG. 16 shows a cut away view of the insert of FIG. 12.
Figure 18:
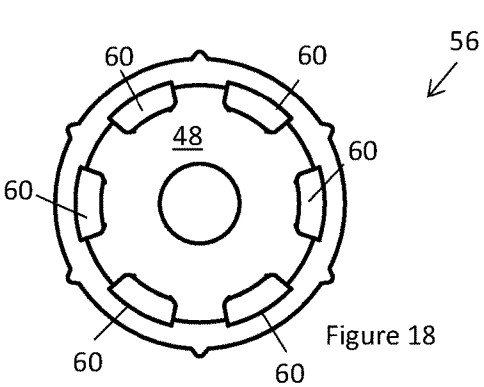
FIG. 18 shows a view of another end of the insert of FIG. 12.
Figure 15:
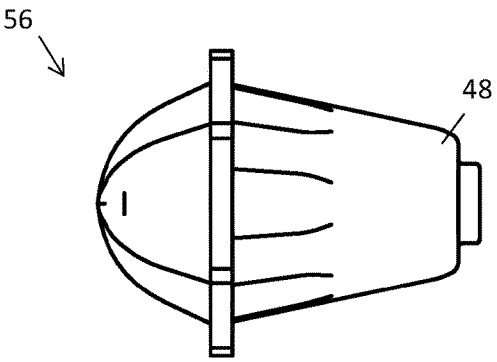
FIG. 15 shows a plan view of the insert of FIG. 12.
Figure 14:
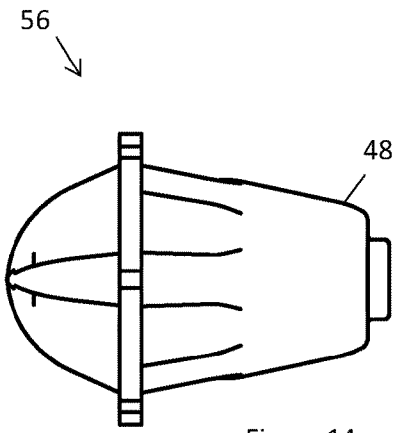
FIG. 14 shows side elevation view of the insert of FIG. 12.
Figure 17:
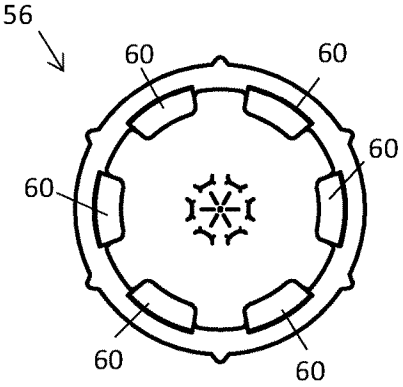
FIG. 17 shows a view of an end of the insert of FIG. 12.
Figure 20:
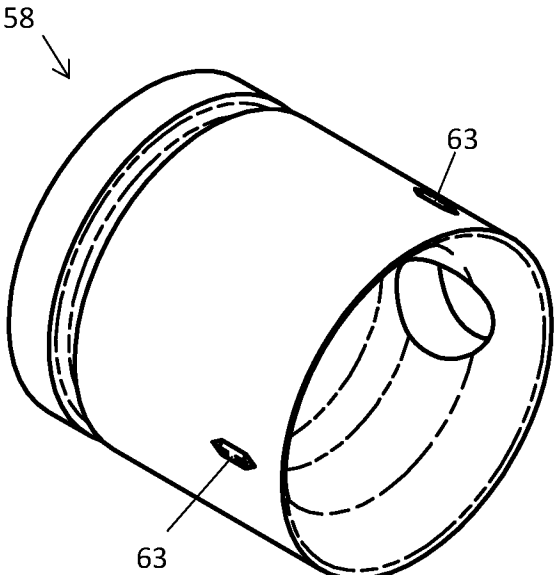
FIGS. 19 and 20 show perspective views of a sleeve of the tap of FIG. 1.
Figure 19:
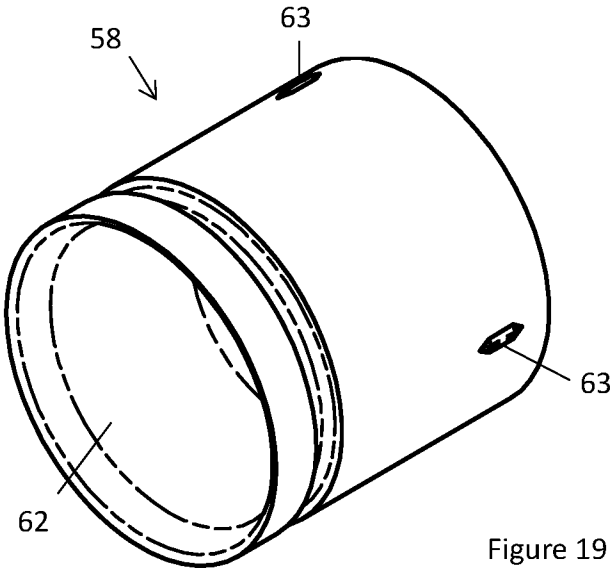
Figure 21:
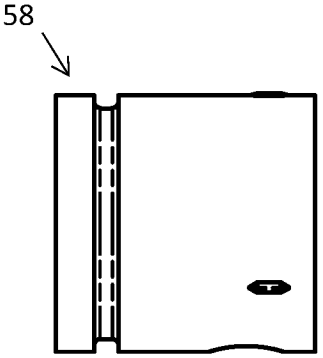
FIG. 21 shows plan view of the sleeve of FIG. 19.
Figure 22:
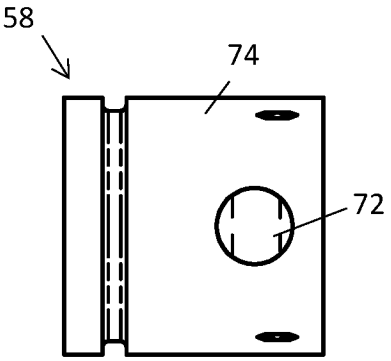
FIG. 22 shows a side elevation view of the sleeve of FIG. 19.
Figure 23:
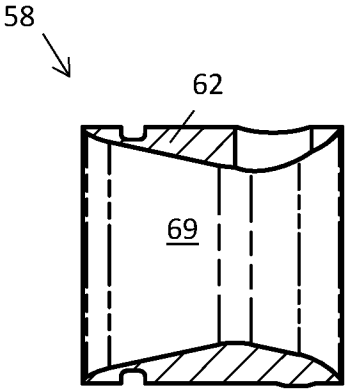
FIG. 23 show a cross section view of the sleeve of FIG. 19.
Figure 24:
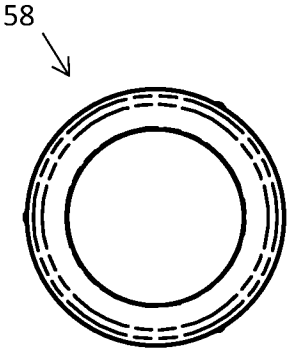
FIG. 24 shows a view of one end of the sleeve of FIG. 19.
Figure 25:
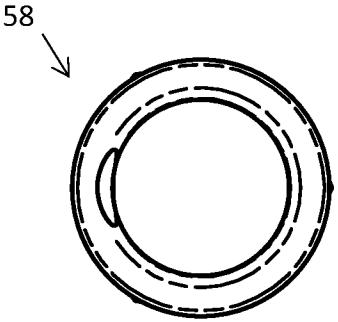
FIG. 25 shows a view of another end of the sleeve of FIG. 19.

FIGS. 3 and 4 show cross sectional views of the tap 10 in off (closed) and on (open) configurations respectively, with the optional handle 16 detached and removed from an externally operable actuator 18 in the form of a lever. The inlet end 13 of the tap 10 is threadingly engaged to pipe shank 21. Actuator 18 comprises an external shaft 20 having a threaded outer surface 22 for threaded engagement with the optional handle 16. The body 12 comprises a closure member seat 22 adjacent the outlet 14 or outlet end 19 of the tap 10. A closure member 24 (called a valve in associated U.S. provisional application 63/085,067 file 29 Sep. 2020) in the form of a shuttle is movably disposed within beverage passageway 26 defined by the tap body 12. The beverage passageway 26 connects an inlet 28—defined by an attachment end 30—and outlet 14. The closure member seat 22 is intermediate the closure member 24 and the outlet 14. In the context of this document, forward sealing means the closure member 24 is moved towards the outlet 14 to close the tap 10, and away from the outlet 14 to open the tap.

The closure member 24 comprises a head 32 movable into sealing engagement with the closure member seat 22. The externally operable actuator 18 is operationally coupled to the closure member 24 to move the closure member 24 and so the head 32 into sealing engagement with the closure member seat 22.

FIGS. 5 to 13 show further views of the bomb-shaped closure member 24. The head 32 has a streamlined configuration, which may reduce turbulent beverage flow within the tap 10. In the context of this document, streamlined means having a form that generates non-turbulent beverage flow. Turbulent beverage flow may result in excessive foaming of the beverage. In the case of the beverage being beer, for example, excessive foaming can result in a beer head that is too large, and remove carbonation from the liquid portion of the beer. The head 32 comprises a rounded portion 34 and a tip 36 having a nipple configuration, such that the head is generally smooth and fissure free. The smooth curves promotes turbulence free flow and the absence of fissures improves hygiene and ease of cleaning. The closure member 24 also comprises a tail 38 having a streamlined configuration, which may also reduce turbulent beverage flow. The tail 38 is rounded such that it is generally smooth and fissure free.

The closure member 24 comprises a plurality of laterally disposed alignment elements 40,42,44 in the form of longitudinally orientated ribs that are aft of the head 32. The alignment elements 40,42,44 extend radially outward to the maximum radius of the head 32. The alignment elements 40,42,44 engage the passageway wall 25 of passageway 26, centering the head 32 therein and aligning the head 32 with the closure member seat 22. Each of the plurality of laterally disposed alignment elements have a streamlined configuration and comprise a tapered forward end 46 directed towards the outlet 14 and rounded aft end 38. Interior end 50 of actuator 18 is received within a cavity 52 defined by the closure member 24. Interior end 50 terminates in a round bearing for smooth operation.

Figure 26:
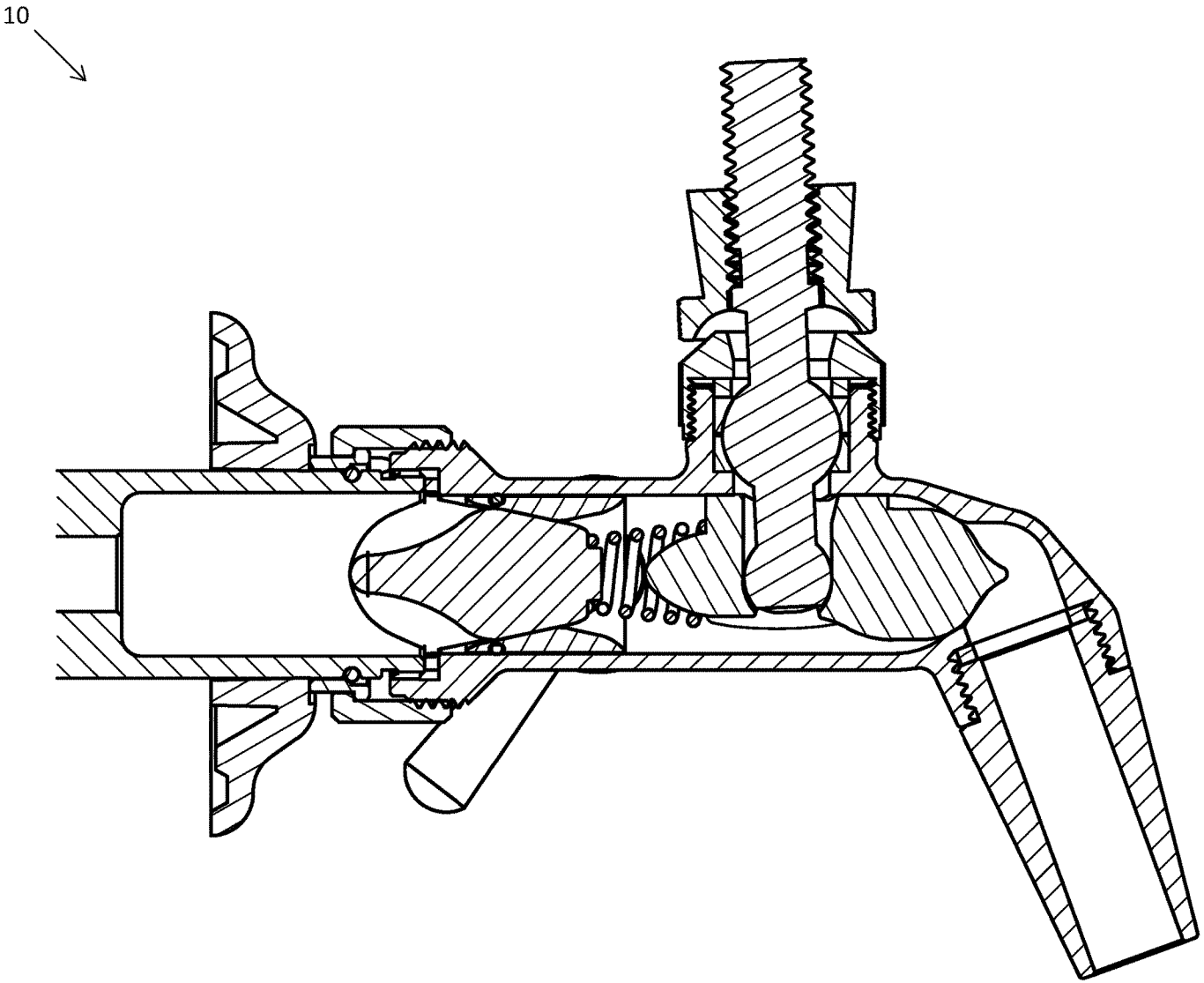
FIGS. 26 and 27 show cross sectional views of the tap 10 of FIG. 1 in off (closed) and on (open) configurations respectively, with a flow constructor in a mode for less flow through the tap.
Figure 27:
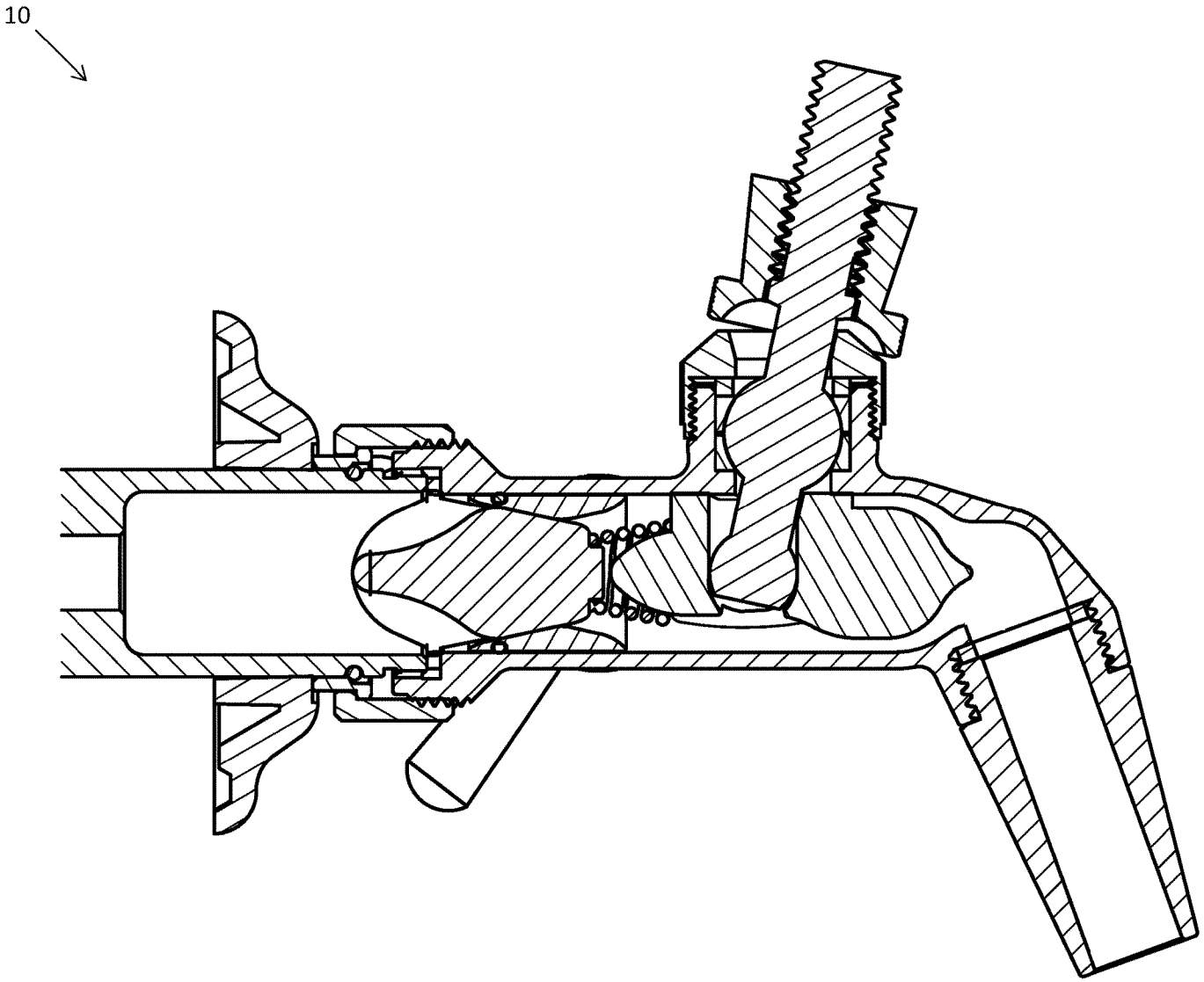

An externally adjustable passageway constrictor 54—for adjusting a flow rate of the beverage through the beverage passageway—is disposed in the beverage passageway 26. The externally adjustable passageway constrictor 54 comprises an insert 56, various views of which are shown in FIGS. 12 to 18. The insert 56 comprises a plurality of through holes 60 that promote longitudinal flow, which can promote laminar flow. The externally adjustable passageway constrictor 54 comprises a sleeve 58 defining a cavity 69, various views of which are shown in FIGS. 19 to 25. The insert 56 comprises a tapered end 48 inserted within the sleeve 58. The sleeve 58 defines a tapered end receiver 62 that is correspondingly tapered. The sleeve 58 is movable mounted within the beverage passageway 26. The tap 10 comprises another externally operable actuator 64 comprising other handle 66 in the form of a lever handle. The other externally operable actuator 64 is operationally coupled to the sleeve 58 for sliding actuation thereof. The other externally operable actuator 64 comprises an actuator spindle 70 to which is attached cam 68. Cam 68 is radially displaced from the axis of rotation of actuator spindle 70, and so revolves around the axis of rotation when actuator 64 is operated. Cam 68 is received within aperture 72 defined by the sidewall 74 of the sleeve 58, and rotation of cam 68 results in linear translation of the sleeve towards or away from the insert 56, which in turn changes the size of a gap 76 between the sleeve 58 and the insert 56. The beverage flow rate may increase with the size of the gap 76. FIGS. 3 and 4 show the gap 76, which has been closed in FIGS. 26 and 27 by contact between the sleeve 58 and the insert 56.

The other externally operable actuator 64 comprises seals 71, 73, 75 and 77. The tap 10 comprises an optional detachable spout 15 that is threadingly engaged with the tab body 12. A washer 17 is intermediate the spout 15 and the tap body 12. The spindle 70 is fixed to the tap body 12 by threadingly engaged bonnet 79.

Associated with the actuator 18 is bonnet 90, handle collar 92, rubber compound cushion 94, and high density polyethylene bushings 96 and 98.

Sleeve 58 comprises optional exterior locating legs 63 in the form of ribs that in use simultaneously contact the tap body 12 for locating the sleeve 58 centrally within the beverage passageway 26. Optional O-ring seal 65 is seated in circumferential groove 67.

The tap 10 comprises an optional closure member biasing element 78 in the form of a compression spring that is disposed within the cavity 69 defined by sleeve 58. One end of the biasing member 78 engages the closure member 24 and at the other end of the biasing member engages the insert 56. A boss 97 of the insert 56 and the aft end 38 of the closure member 24 are disposed within the spring 78 such that the spring is located thereby within the passageway, in this embodiment at the centre of the passageway 26. The closure member biasing element 58 biases the closure member 24 into engagement with the closure member seat 22. The tap 10 may consequently be self-closing, specifically a self forward closing beverage tap. The tap 10 functions with the biasing element removed, but is no longer self-closing. Consequently, a user can determine whether the tap is self-closing or not by including or omitting the biasing element 78.

The tap 10 comprises polymer, specifically the closure member 24, and the externally adjustable passageway constrictor 56. The polymer has a lower specific heat than the metal tap body comprising brass, for example, which reduces the amount of heat transferred from the tap 10 to the beverage. This may result in a colder dispensed beverage with less foaming. The closure member 24 comprises a skeleton comprising polypropylene over molded with thermoplastic vulcanizates. Generally, the over mold may comprise any suitable thermoplastic elastomer, injection moldable elastomer, or polymer.

Figure 29:
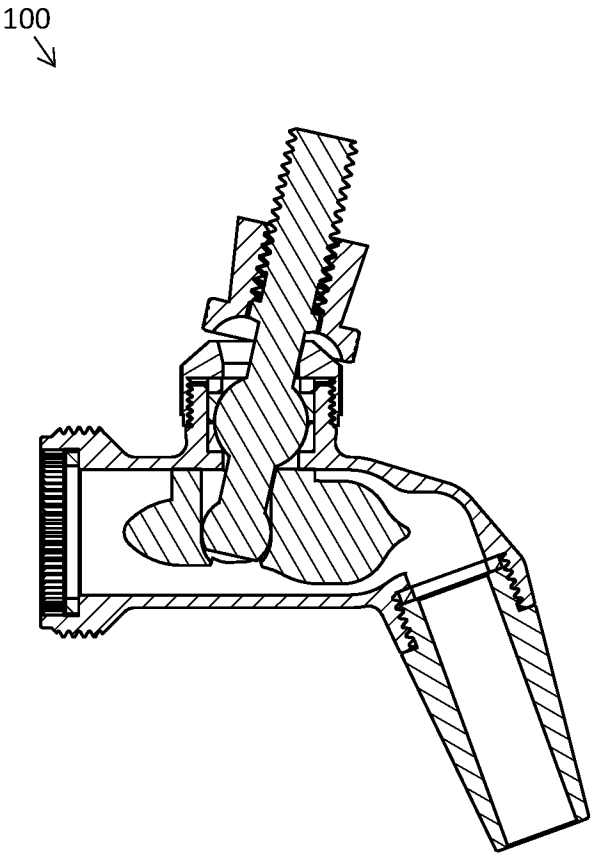
FIGS. 28 and 29 shows cross section views of another embodiment of a beverage tap.
Figure 28:
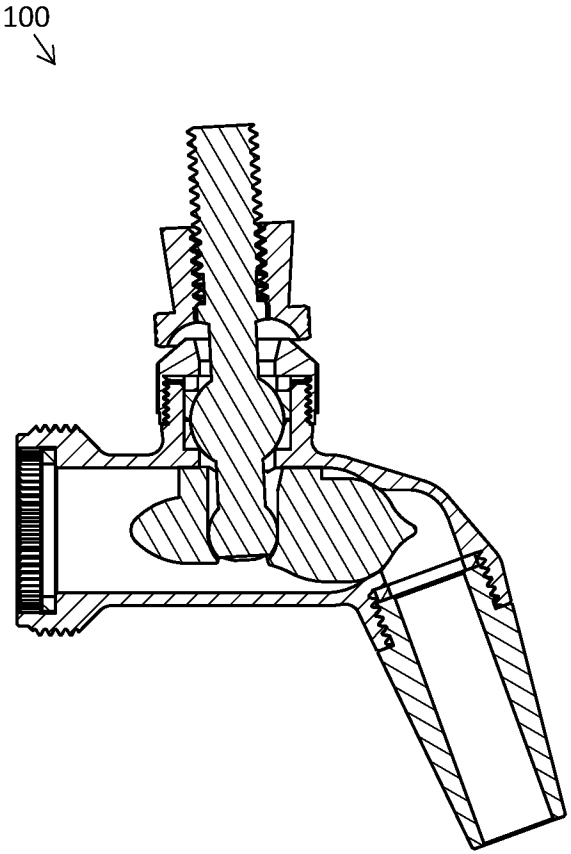

FIGS. 28 and 29 show cross section views of another embodiment of a tap 100 similar to tap 10, however without the externally adjustable passageway constrictor 54.

Now that embodiments have been described, it will be appreciated that some embodiments may have at least some of the following advantages:

- Turbulent flow of the beverage through the tap—which may cause excess foaming—may be reduced.
- High levels of hygiene may be achieved
- Embodiments may be easier to clean than prior art beverage taps
- The dispensed beverage may be cooler, which may assist in preventing the formation of excess foaming.
- Polymer components may be resistant to commonly used cleaning chemicals and may have good molding properties.
- The tap, which is forward closing, can be self-closing by including the spring 78.

Variations and/or modifications may be made to the embodiments described without departing from the spirit or ambit of the invention. For example:

- The long handle 16 may take the form of a short lever, or may be replaced with, for example, a pull chain, or generally may be any suitable form of user control.
- The tap 10 may be configured to attach to a quick-connect, for example, or other attachment.
- The spring may be an extension spring disposed on the other side of the sleeve, for example.

The present embodiments are, therefore, to be considered in all respects as illustrative and not restrictive. Reference to a feature disclosed herein does not mean that all embodiments must include the feature.

Prior art, if any, described herein is not to be taken as an admission that the prior art forms part of the common general knowledge in any jurisdiction.

In the claims which follow and in the preceding description of the invention, except where the context requires otherwise due to express language or necessary implication, the word "comprise" or variations such as "comprises" or "comprising" is used in an inclusive sense, that is to specify the presence of the stated features but not to preclude the presence or addition of further features in various embodiments of the invention.

The invention claimed is:

1. A beverage tap comprising:

a tap body defining a beverage outlet and comprising a closure member seat, wherein the tap body defines a beverage passageway;

a closure member movably disposed within the tap body and comprising a head movable into sealing engagement with the closure member seat, wherein the head has a streamlined configuration and the closure member seat is intermediate the closure member and the beverage outlet;

an externally operable actuator operationally coupled to the closure member; and an externally adjustable passageway constrictor, disposed in the beverage passageway, for adjusting a flow rate of the beverage through the beverage passageway.

2. A beverage tap defined by claim 1 wherein the head comprises a rounded portion.

3. A beverage tap defined by claim 1 wherein the head comprises a tip having a nipple configuration.

4. A beverage tap defined by claim 1 wherein the head is smooth.

5. A beverage tap defined by claim 1 wherein the head is fissure free.

6. A beverage tap defined by claim 1 wherein the closure member comprises a tail having a streamlined configuration.

7. A beverage tap defined by claim 6 wherein the tail comprises a rounded portion.

8. A beverage tap defined by claim 6 wherein the tail is smooth.

9. A beverage tap defined by claim 6 wherein the tail is fissure free.

10. A beverage tap defined by claim 1 wherein the closure member comprises a plurality of laterally disposed alignment elements aft of the head.

11. A beverage tap defined by claim 10 wherein each of the plurality of laterally disposed alignment elements have a streamlined configuration.

12. A beverage tap defined by claim 10 wherein each of the laterally disposed alignment elements comprise a tapered forward end directed towards the outlet and rounded aft end.

13. A beverage tap defined by claim 10 wherein the actuator is received within a cavity defined by the closure member.

14. A beverage tap defined by claim 10 wherein the closure member comprises polymer.

15. A beverage tap defined by claim 1 wherein the closure member comprises a skeleton overmolded with a polymer overmold.

16. A beverage tap defined by claim 1 wherein the externally adjustable passageway constrictor comprises an insert comprising a tapered end inserted within a sleeve defining a tapered end receiver that is correspondingly tapered.

17. A beverage tap defined by claim 16 wherein the sleeve is moveably mounted within the beverage passageway.

18. A beverage tap defined by claim 16 comprising a closure member biasing element intermediate of the closure member and the insert.

* * * * *